US005588272A

United States Patent [19]

Haponski

[11] Patent Number: 5,588,272

[45] Date of Patent: Dec. 31, 1996

[54] REINFORCED MONOLITHIC CONCRETE WALL STRUCTURE FOR SPANNING SPACED-APART FOOTINGS AND THE LIKE

[76] Inventor: Edward L. Haponski, P.O. Box 456, Coats, N.C. 27521

[21] Appl. No.: 345,857

[22] Filed: Nov. 28, 1994

[51] Int. Cl.[6] ..... E04B 1/04

[52] U.S. Cl. ..... 52/309.12; 52/125.4; 52/405.3

[58] Field of Search ..... 52/405.1, 407.2, 52/407.4, 258, 259, 260, 274, 275, 309.12, 741.14, 742.14, 251, 122.1, 125.3, 125.4, 124.2, 293.3, 295, 296, 309.1, 309.4, 309.6, 309.12

[56] References Cited

U.S. PATENT DOCUMENTS

| | | | |
|---|---|---|---|
| 1,682,253 | 8/1928 | Romero et al. | 52/274 |
| 2,886,370 | 5/1959 | Liebert | 52/125.3 X |
| 4,669,240 | 6/1987 | Amormino | 52/259 X |
| 5,055,252 | 10/1991 | Zimmerman | 52/309.12 X |
| 5,060,436 | 10/1991 | Delgado, Jr. | 52/295 |
| 5,067,298 | 11/1991 | Petersen | 52/309.4 X |
| 5,119,606 | 6/1992 | Graham . | |
| 5,129,203 | 7/1992 | Romero . | |
| 5,335,472 | 8/1994 | Phillips . | |
| 5,381,635 | 1/1995 | Sanger | 52/309.12 X |
| 5,404,685 | 4/1995 | Collins | 52/309.12 X |
| 5,522,194 | 6/1996 | Graulich . | |

*Primary Examiner*—Creighton Smith
*Attorney, Agent, or Firm*—Rhodes, Coats & Bennett, L.L.P.

[57] ABSTRACT

The present invention relates to a monolithic concrete wall structure and more particularly to a reinforced, precast, insulated concrete wall structure. The wall structure of the invention has an enlarged, upper reinforced horizontal concrete beam that helps carry various stresses and loads present in a residential or commercial structure. The wall structure also has a three-layer insulated main section that includes integrated vertical support columns for added strength. The wall structure is strong enough to span spaced-apart footings without additional reinforcement, thereby eliminating the need for a continuous foundation footing.

22 Claims, 4 Drawing Sheets

REINFORCED MONOLITHIC CONCRETE WALL STRUCTURE FOR SPANNING SPACED-APART FOOTINGS AND THE LIKE

FIELD OF INVENTION

The present invention relates to monolithic concrete wall structures and more particularly to a reinforced, precast, insulated wall structure having an enlarged, upper reinforced horizontal concrete beam.

BACKGROUND OF THE INVENTION

There is a growing trend in the commercial and residential building industry toward replacing wood with alternative building materials. With the depletion of the world's forests, lumber is becoming less desirable as a building material because of both the ecological and economic consequences. The price of lumber, especially hardwoods from nearly extinct old-growth forests, fluctuates greatly, most often upwardly, as supplies grow scarcer. Wood is also generally the least durable of common building materials from both a structural and an aesthetic standpoint. Rotting, termite infested wood undermines the integrity of a structure built of it, and faded, weathered wood detracts from the appearance of buildings. Additionally, wood buildings present a greater fire hazard than do buildings constructed of less flammable materials.

Prefabricated concrete building panels offer a safe and relatively inexpensive alternative to wood and are easier to build with than brick, which requires skilled masons and artisans for proper construction. Building with prefabricated concrete panels lowers building costs because of both the relatively low cost of the materials themselves and because of the relatively minimal skill required to build with them. This low cost is especially important when constructing, for example, affordable housing projects or commercial buildings.

Many prefabricated building panels have been developed by inventors in efforts to solve various problems associated with building construction. For example, several panel designs are disclosed in U.S. Pat. Nos. 3,745,731; 3,948,008; 4,2311,199; 4,512,126; 4,909,001; 5,065,558; and 5,313,753. These patents describe various concrete panel designs and methods of construction using them.

Most all of these related art building panels have shortcomings that make them unsuitable or inadequate for many construction applications. For example, some of them require more than minimally skilled workers for construction, others are expensive, and most of them require additional support and reinforcement because the panels alone are not strong enough to withstand the various forces and stresses placed on them in building applications.

Therefore, there is a need for a reinforced, precast concrete building structure that includes all necessary support members, is relatively inexpensive, and is easily used in construction.

SUMMARY AND OBJECTS OF THE INVENTION

The present invention entails an insulated, reinforced, monolithic concrete wall structure for spanning spaced-apart footings, piers, and the like that includes a vertical main section, vertical concrete columns and a lower horizontal beam built into the main section, and a thicker, upper horizontal concrete beam. The vertical main section has three layers: a pair of reinforced, opposed concrete panels and insulation boards sandwiched between the opposed concrete panels. The insulation boards are arranged so that at regular intervals, gaps between the insulation boards provide spaces for the vertical concrete columns, which are integral with the opposed concrete panels and are reinforced with longitudinal rods. Likewise, the lower horizontal beam extends along the bottom of the main section below the insulation boards and is also integral with the opposed concrete panels. The large, upper horizontal concrete beam is integral with and positioned on top of the vertical main section and the vertical concrete columns. Viewed from the end, the upper horizontal concrete beam is square-shaped, and one side of it is flush with the outer surface of the vertical main section. The upper horizontal concrete beam is considerably thicker than the main section, giving the entire wall structure an inverted L-shape when viewed from an end. Like the vertical concrete columns, the upper horizontal concrete beam is also reinforced with longitudinal rods.

The present invention also entails a particular process for forming this wall structure. First, reinforcing longitudinal rods and various attachment members are disposed in a mold such that the reinforcing rods extend throughout the interior of both upper and lower portions of the mold. A first concrete panel is then poured into the mold and a wire mesh panel is embedded in this first concrete panel. Next, insulation boards are placed on top of the first concrete panel in such a way that a space is left between each board. Air between the insulating boards and the first concrete panel is removed by pressing on the insulation boards, and another wire mesh panel is then positioned above the insulation boards.

Finally, a second concrete panel is poured over the insulation boards and the second wire mesh panel. The concrete in the spaces between the insulation boards forms the vertical support columns, which are integral with the concrete panels and, thus, invisible in a completed wall structure.

The design of the present invention produces an aesthetically attractive concrete wall structure that is strong enough to be used to span spaced-apart footings or piers as opposed to panels that require a continuous footing. The upper horizontal beam greatly increases the overall strength of the structure as do the integrated vertical support columns and the lower horizontal beam. The upper beam takes lifting stress, helps carry horizontal wind loads, and handles compressive loads transferred by the upper part of a building built with the present invention. The longitudinal reinforcing rods in the upper horizontal beam handle tensile loads.

It is therefore an object of the present invention to provide a precast, reinforced concrete wall structure that is strong enough to span spaced-apart footings, piers, and the like without the need for additional support members or a continuous foundation footing.

It is another object of the present invention to provide a precast, reinforced concrete wall structure that is easier to build with than other concrete panels and brick, thereby eliminating the need for highly skilled and correspondingly highly paid workers.

It is another object of the present invention to provide a precast, reinforced concrete wall structure having an upper horizontal beam that takes lifting stress, helps carry horizontal wind loads, and handles compressive loads transferred by the upper part of a building utilizing the invention.

A further object of the present invention is to provide a process for manufacturing the reinforced, monolithic concrete wall structure referred to above, which can be easily and inexpensively performed by relatively unskilled laborers.

Other objects and advantages of the present invention will become apparent and obvious from a study of the following description and the accompanying drawings, which are merely illustrative of such an invention.

DETAILED DESCRIPTION OF THE INVENTION

Figure 1:
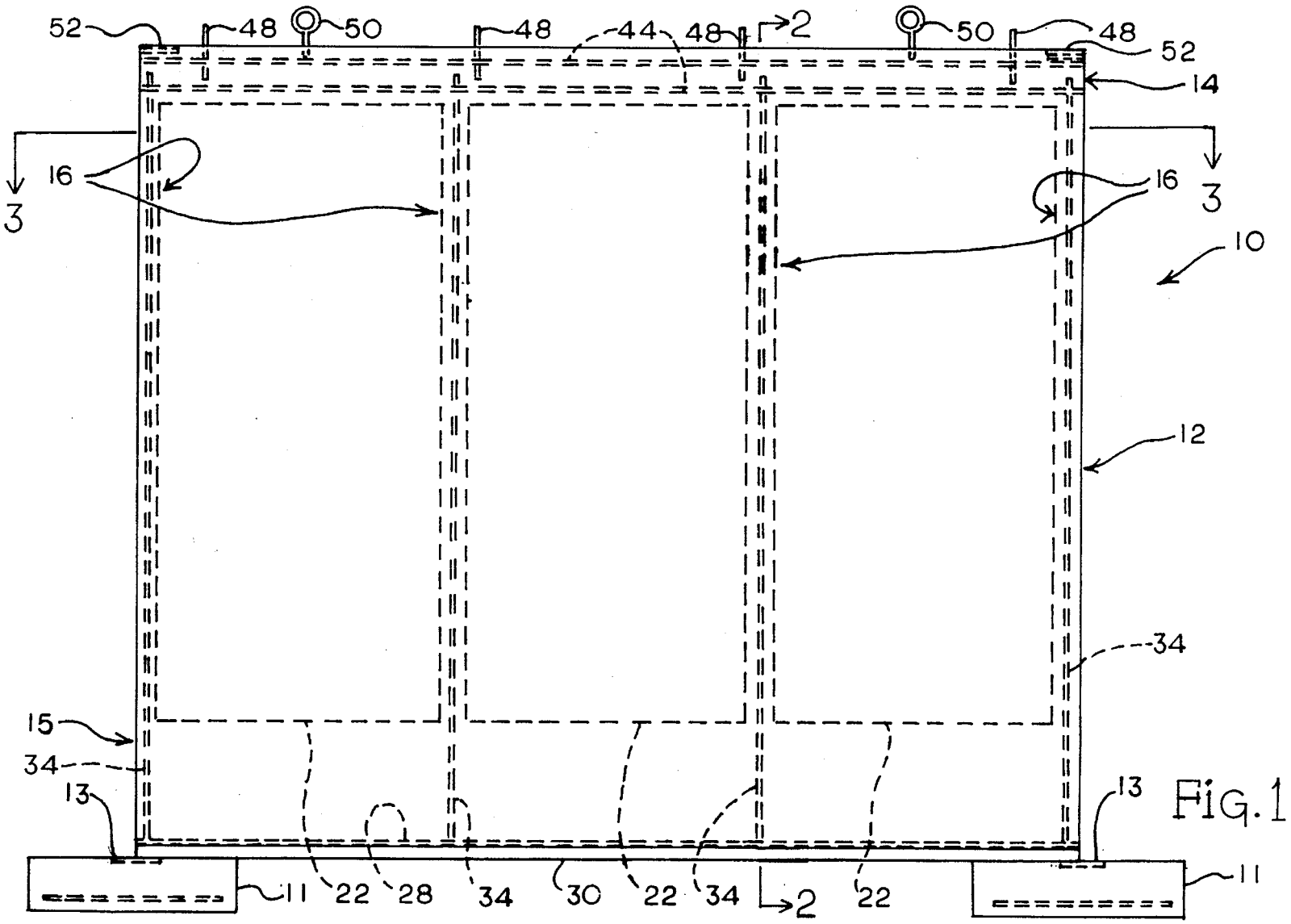
FIG. 1 is a front elevational view of the concrete wall structure of the invention.

With further reference to the drawings, the concrete wall structure of the invention is shown therein and generally indicated by the numeral 10. The concrete wall structure 10 includes four general sections or components: a vertical main section, generally indicated by the numeral 12; an upper horizontal concrete beam, generally indicated by the numeral 14; vertical concrete support columns 16; and a lower horizontal beam 15. As can be seen in FIG. 1, the concrete wall structure 10 is strong enough to span two spaced-apart footings 11, with no additional reinforcements and without the need for a continuous foundation footing. It should be appreciated that virtually any size wall structure 10 could be constructed depending on the size of the building in which the wall structure 10 is to be used.

Focusing now on the vertical main section 12, it is seen that it includes two concrete panels 18, 20 that sandwich a series of insulation boards 22. Each concrete panel 18, 20, is reinforced with a reinforcing material such as an embedded wire mesh network 24, 26.

Figure 2:
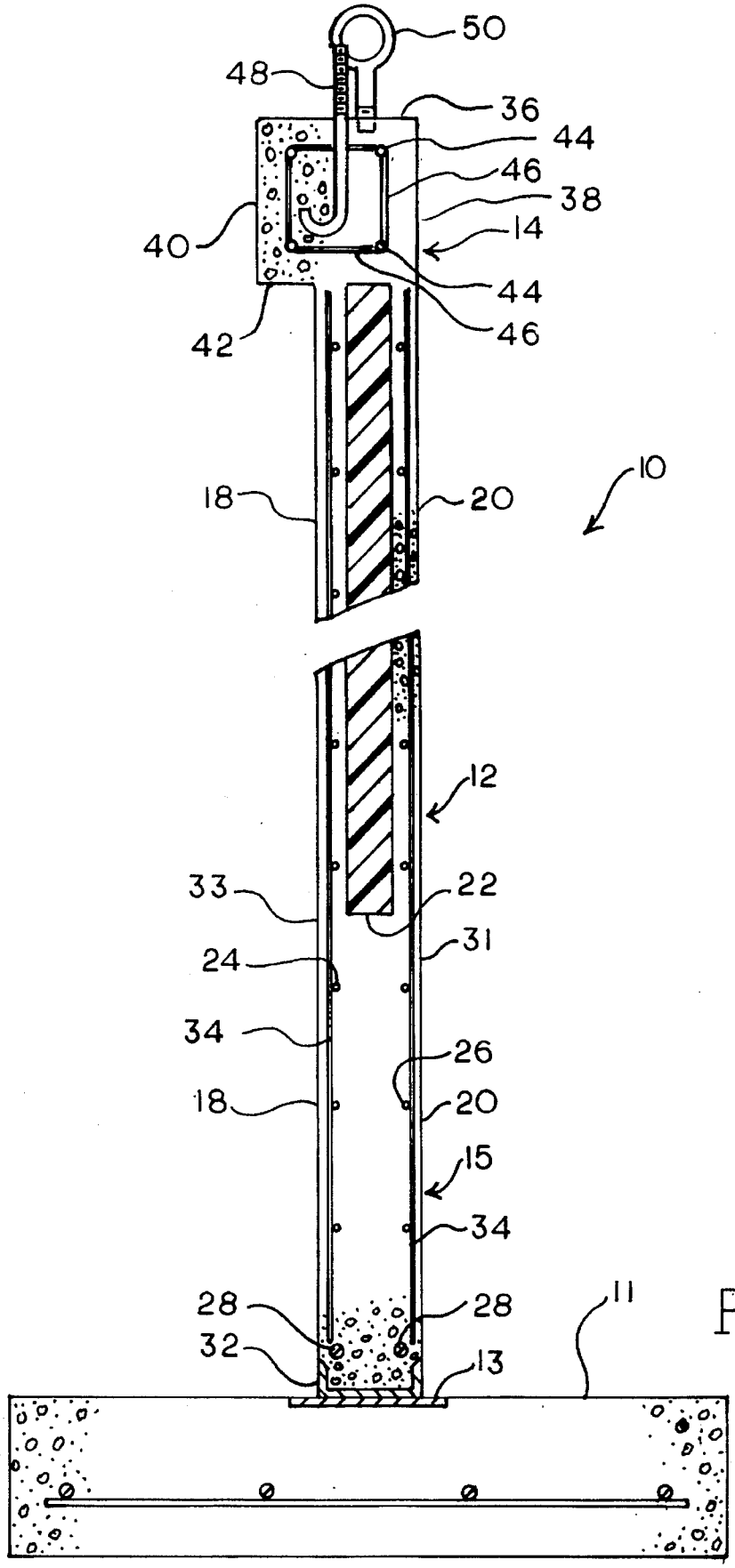
FIG. 2 is a vertical cross-sectional view of the concrete wall structure.

Insulation boards 22 are constructed of a suitable rigid insulating material and, as shown in FIG. 2, do not extend throughout the full height of main section 12. The insulation boards 22 are typically rectangular and are spaced apart from each other as will be explained later.

The lower portion of the main section 12 does not have insulation; therefore, the lower portions of the first and second concrete panels 18, 20 merge together to form a lower horizontal beam 15. Here, the concrete is continuous and solid between outer surfaces 31 and 33. This lower horizontal beam 15 is reinforced by lower reinforcing members 28, which may be steel reinforcing bars. At the bottom of the lower horizontal beam 15 is the lower unsupported edge 30. This edge 30 extends between spaced-apart footings 11 and need not rest on a continuous foundation as do typical wall panels. Embedded in the lower horizontal beam 15 are steel connection plates 32 for connecting the wall structure 10 to a footing 11. The footings 11 shown here each have an embedded anchor plate 13. Typically, each connection plate 32 is welded to an anchor plate 13 to provide a secure and fixed joint.

Figure 3:
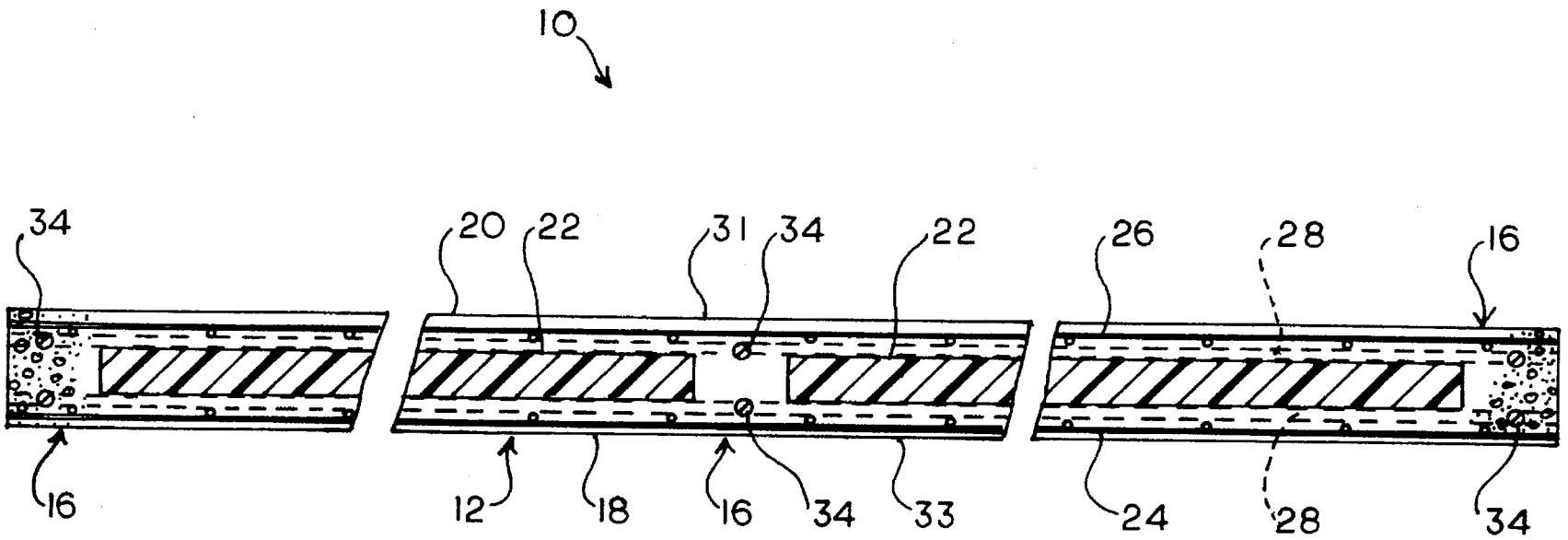
FIG. 3 is a horizontal cross-sectional view of the main section of the wall structure.

As mentioned earlier, the insulation boards 22 are spaced apart from each other. As depicted in FIG. 3, there is a substantial gap between each insulation board 22. These gaps provide the spaces for the vertical concrete columns 16, which are reinforced with vertical reinforcing members 34, which may be steel reinforcing bars. It should be understood that vertical concrete columns 16 extend the entire height of the main section 12 and are integral with the concrete panels 18, 20. As can be seen from FIGS. 1 and 3, the vertical concrete columns 16 are flush with the outer surfaces 31, 33 of the main section 12 and are, thus, invisible from the exterior of the wall structure 10.

The wall structure 10 is strengthened by the inclusion of the upper horizontal concrete beam 14. As shown in FIG. 2, this beam 14 has a square-shaped cross-section and is considerably thicker than the main section 12, giving the upright, erected wall structure 10 an inverted L-shape when viewed from an end. The bottom 42 of the beam 14 is integral with concrete panels 18, 20. Side 38 of the beam 14 is coplanar with one outer surface 31 of the main section 12, whereas side 40 of the beam 14 is not coplanar with the opposite outer surface 33 of the main section 12, giving the wall structure 10 its inverted-L-shaped profile.

The upper horizontal concrete beam 14 is reinforced internally by four horizontal reinforcing members 44 connected to each other by tie members 46. The horizontal reinforcing members 44 may be steel reinforcing bars, and the tie members 46 may typically be metal wire or straps.

Figure 4:
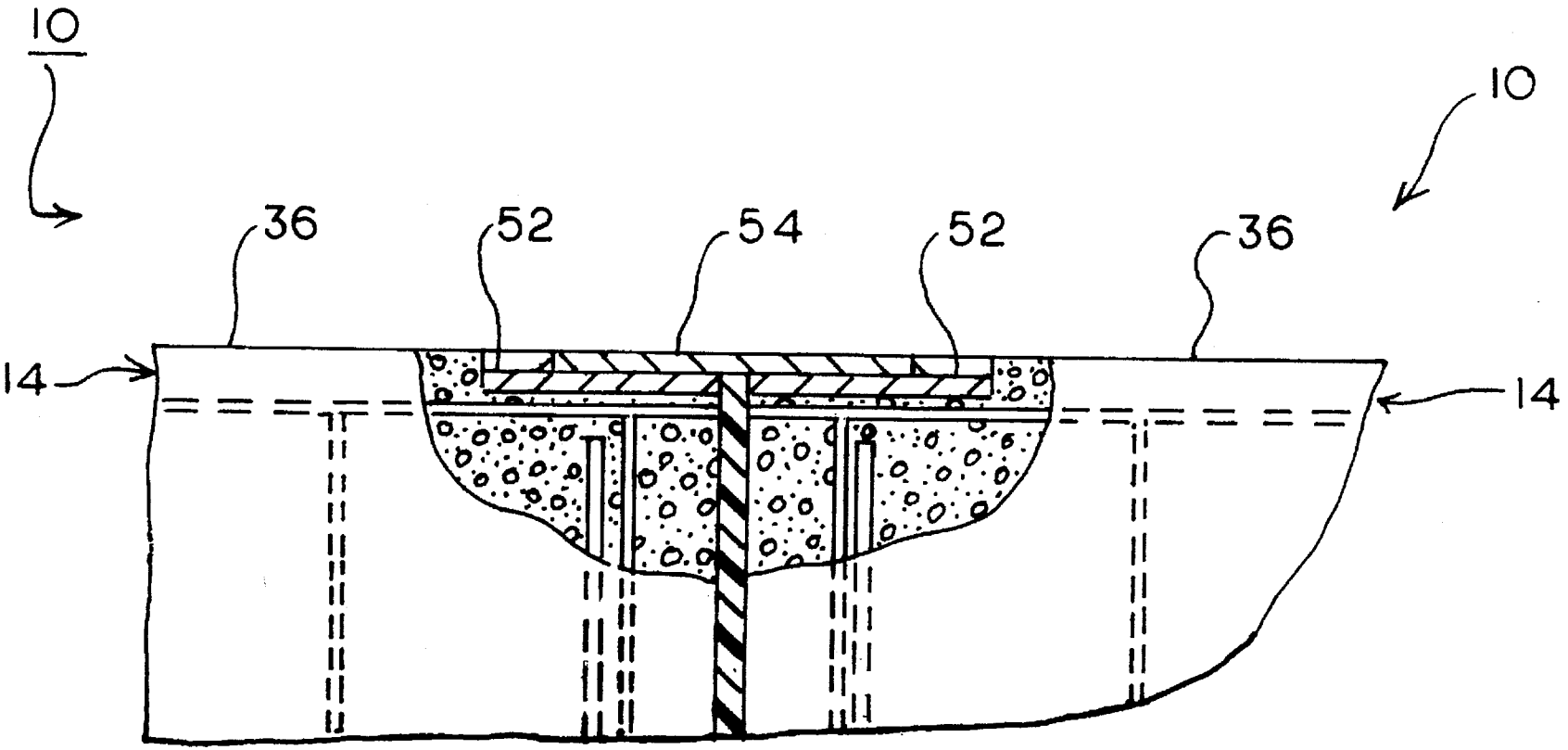
FIG. 4 is a fragmentary side elevational view illustrating a connecting structure for joining two adjacent concrete wall structures.

Embedded in the top 36 of the beam 14 are lifting inserts 50 for lifting the wall structure 10 with a crane or the like. Also embedded in the top 36 of the beam 14 are anchoring members such as J-anchor bolts 48, which are used to attach upper building portions such as a second floor or rafters to the wall structure 10. Upper embedded weld plates 52 on each end of the top 36 of the beam 14 are used to fasten the wall structure 10 to an adjacent wall structure 10. FIG. 4 shows an enlarged fragmentary view of these weld plates 36 to which are welded a tie plate 54, which securely joins two wall structures 10.

The present invention also entails a particular process for forming this concrete wall structure 10. First, a mold is constructed in the shape of the wall structure 10, with a depression for the upper horizontal concrete beam 14 dropping deeper than the mold area for the main section 12. Next, four horizontal reinforcing members 44 are connected by tie members 46 to form a square cage-like structure, which provides the reinforcement for the beam 14. This cage-like structure is disposed within the deeper beam area of the mold. Also in the beam area of the mold, the J-anchor bolts 48, the lifting inserts 50, and the upper embedded weld plates 52 are set in place. In the main section area of the mold, lower reinforcing members 28, vertical reinforcing members 34, and connection plates 32 are set into place. In all cases, the reinforcing members 28, 34, 44 are suspended above the bottom of the mold so they are not exposed on surfaces 33, 40 of the finished wall structure 10.

Next, the first concrete panel 18 is poured along with the portion of the beam 14 that gives the structure 10 its L-shape. Immediately after the first panel 18 is poured, a wire mesh panel 24 is placed atop the first panel 18 and then the wet concrete is vibrated so that the mesh panel 24 sinks approximately halfway down into the wet concrete of the first panel 18.

The insulation boards 22 are then placed atop the wet concrete of the first panel 18 in such a way that spaces for the vertical columns 16 are left between the boards 22. The insulation boards 22 are pressed downwardly to remove any air trapped between the boards 22 and the first panel 18. Another wire mesh panel 26 is then suspended slightly above the insulation boards 22 before the second concrete panel 20 is poured into the mold. This final pour leaves the side 38 of the beam 14 and the surface 31 of the main section 12 smooth and coplanar for a seamless exterior appearance of a wall of a building or the like. The final pour also fills in the spaces between the insulation boards 22 to create the vertical concrete columns 16.

The concrete wall structure 10 of the invention is especially useful when building affordable housing. The upper horizontal concrete beam 14 helps provide sufficient strength for the wall structure 10 to span spaced-apart footings 11, rendering unnecessary a continuous foundation footing, which is more costly than spaced piers. The beam 14 takes lifting stress transferred through the lifting inserts 50, helps carry horizontal wind loads, and, with the vertical columns, handles the compressive loads placed on the structure 10 by a roof or a second story. The horizontal reinforcing members 44 handle tensile loads.

The present invention may be carried out in other specific ways than those set forth herein without parting from the spirit and essential characteristics of the invention. The present embodiment is, therefore, to be considered in all respects as illustrative and not restrictive, and all changes coming within the meaning and equivalency range of the appended claims are intended to be embraced therein.

What is claimed is:

1. A precast, reinforced concrete wall structure for spanning spaced-apart footings and forming a part of a building structure, comprising:

a) a noncased vertical main section including a pair of opposed concrete panels, an insulation board disposed between the concrete panels such that the insulation board is covered on opposite sides with concrete and effectively embedded within the concrete that forms the pair of opposed concrete panels whereby the embedded insulation board retains heat within the building structure, and reinforcing material embedded within each concrete panel;

b) wherein the opposed concrete panels wrap around the insulation board and form a single concrete structure;

c) a plurality of vertical concrete columns integral with the concrete panels and extending continuously from a bottom portion of the concrete wall structure to a top portion of the concrete wall structure and wherein the insulation board is disposed between the plurality of vertical concrete columns and wherein the columns are reinforced and disposed about opposite end portions of the concrete wall structure so as to permit the concrete wall structure to span two spaced apart footings; and d) an upper horizontal concrete beam integral with and positioned atop the vertical main section and the vertical concrete columns, the upper horizontal concrete beam including a plurality of horizontal reinforcing members and being thicker than the vertical main section, and wherein the upper concrete beam strengthens the concrete wall structure such that the same can span the spaced-apart footings.

2. The wall structure of claim 1 wherein the reinforcing material of the opposed concrete panels comprises wire mesh.

3. The wall structure of claim 1 wherein the vertical and horizontal reinforcing members include steel reinforcing bars.

4. The wall structure of claim 1 wherein the upper horizontal concrete beam has a square-shaped cross section and the wall structure, when erected, has a generally inverted L-shaped cross section.

5. The wall structure of claim 1 , wherein each of the opposed concrete panels is substantially a same thickness.

6. The wall structure of claim 1, further comprising at least one connection plate embedded in the wall structure for connecting the wall structure to the footings.

7. The wall structure of claim 1, further comprising at least two lifting inserts embedded in the upper horizontal concrete beam for lifting the wall structure.

8. The wall structure of claim 1, wherein the main section also includes a lower unsupported edge for extending between the spaced-apart footings.

9. The wall structure of claim 1, further comprising a lower horizontal concrete beam integral with the main section.

10. The combination of claim 1 further including two spaced apart footers for supporting the concrete wall structure such that when erected the concrete wall structure spans the spaced apart footers and is unsupported continuously between the footers.

11. A precast, reinforced, monolithic concrete wall structure for spanning spaced-apart footings used in building construction and forming a part of a building structure, comprising:

a) a noncased vertical main section including a pair of opposed concrete panels;

b) an insulation board sandwiched between the two concrete panels such that the insulation board is covered on opposite sides with concrete and effectively embedded within the concrete that forms the pair of opposed concrete panels whereby the embedded insulation board retains heat within the building structure;

c) wherein the opposed concrete panels wrap around the insulation board and form a single concrete structure;

d) reinforcing material embedded in each concrete panel;

e) a plurality of vertical concrete columns integral with the concrete panels and extending continuously from a bottom portion of the concrete wall structure to a top portion of the concrete wall structure and wherein the insulation board is disposed between the plurality of vertical concrete columns and wherein the columns are reinforced and disposed about opposite end portions of the concrete wall structure so as to permit the concrete wall structure to span to spaced apart footings;

f) at least one vertical reinforcing member embedded in each vertical concrete column;

g) an upper elongated, horizontal concrete beam integral with the concrete panels and wherein the beam is of a thickness greater than that of the main section, and wherein the upper concrete beam strengthens the concrete wall structure such that the same can span the spaced-apart footings; and h) a plurality of horizontal reinforcing members embedded in the horizontal concrete beam.

12. The wall structure of claim 11, further comprising at least two connection plates embedded in the main section for attaching the wall structure to the spaced-apart footings.

13. The wall structure of claim 12, further comprising a series of spaced-apart anchoring members embedded in the horizontal concrete beam and extending outwardly therefrom for securing rafters atop the wall structure.

14. The wall structure of claim 11, wherein the reinforcing material comprises wire mesh and the vertical and horizontal reinforcing members comprise steel reinforcing bars.

15. The wall structure of claim 11 wherein a single planar outer surface is formed.

16. The wall structure of claim 11, further comprising a lower horizontal concrete beam integral with the main section and including a lower unsupported edge extending between the spaced-apart footings.

17. The wall structure of claim 11, further comprising two upper weld plates embedded in the horizontal beam for joining adjacent wall structures.

18. The combination of claim 10 further including two spaced apart footers for supporting the concrete wall structure such that when erected the concrete wall structure spans the spaced apart footers and is unsupported continuously between the footers.

19. A method of forming and erecting insulated, reinforced, monolithic concrete wall structure used for spanning spaced-apart footings and forming a part of a building structure, comprising the steps of:

a) disposing reinforcing members in a mold such that the reinforcing members extend throughout a upper and lower portions of the mold;

b) pouring a first concrete panel into the mold;

c) embedding reinforcing material into the first panel;

d) positioning an insulation board over the first panel;

e) pressing the insulation board downwardly against the first panel so as to remove air;

f) disposing additional reinforcing material above the insulation board;

g) pouring additional concrete into the mold to form a second concrete panel that is spaced apart from the first panel such that the insulation board is embedded between the two concrete panels and wherein the concrete panels wrap around the insulation board and form a single concrete structure whereby the insulation board retains heat within the building structure;

h) forming at least two vertical concrete columns and consolidating the columns with the concrete panels to form an integral structure and extending a plurality of concrete columns continuously from a bottom portion of the concrete wall structure to a top portion of the concrete wall structure and positioning the insulation board between the plurality of concrete vertical columns and wherein the vertical concrete columns are reinforced and disposed about opposite end portions of the concrete wall structure so as to permit the concrete wall structure to span two spaced apart footers: and i) erecting the concrete wall structure across the two spaced apart footers such that the concrete wall structure spans the spaced apart footers and is unsupported by a continuous foundation.

20. The method of claim 19 wherein the formed concrete wall structure includes an upper elongated concrete beam thicker than the two panels and wherein the beam is poured during the pouring of the first and second concrete panels.

21. The method of claim 19, further comprising the step of positioning a plurality of insulation boards over the first panel, leaving a space between each insulation panel so that concrete poured into each space forms a vertical concrete column.

22. The method of claim 19, further comprising the steps of disposing connection plates, lifting inserts, and anchoring members in the mold so that each becomes embedded in the formed building structure.

* * * * *